US006861808B2

(12) United States Patent
Kakisaka et al.

(10) Patent No.: US 6,861,808 B2
(45) Date of Patent: Mar. 1, 2005

(54) METAL VAPOR DISCHARGE LAMP

(75) Inventors: Shunsuke Kakisaka, Ibaraki (JP); Kazuo Takeda, Sakai (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 10/392,014

(22) Filed: Mar. 19, 2003

(65) Prior Publication Data

US 2003/0209987 A1 Nov. 13, 2003

(30) Foreign Application Priority Data

Mar. 27, 2002 (JP) ..... 2002-089672
Mar. 27, 2002 (JP) ..... 2002-089673

(51) Int. Cl.[7] ..... H01J 1/62
(52) U.S. Cl. ..... 313/642; 313/639
(58) Field of Search ..... 313/639, 640, 313/641, 623, 625, 25; 445/26

(56) References Cited

U.S. PATENT DOCUMENTS 4,499,396 A * 2/1985 Fohl et al. ..... 313/25
5,134,336 A * 7/1992 Chakrabarti et al. ..... 313/25
5,484,315 A * 1/1996 Juengst et al. ..... 445/26
5,532,543 A * 7/1996 Van Der Leeuw et al. ... 313/25
5,729,091 A * 3/1998 Barthelmes et al. ..... 313/638
6,020,685 A * 2/2000 Wei et al. ..... 313/625
6,201,348 B1 * 3/2001 Nortrup et al. ..... 313/573
6,492,764 B2 * 12/2002 Takeda et al. ..... 313/25
6,501,220 B1 * 12/2002 Lambrechts et al. ..... 313/571
6,592,808 B1 * 7/2003 Dynys et al. ..... 419/19
6,696,788 B2 * 2/2004 Lapatovich et al. ..... 313/634
6,713,962 B2 * 3/2004 Nohara et al. ..... 313/623
6,717,364 B1 * 4/2004 Zhu et al. ..... 313/642
6,731,069 B1 * 5/2004 Newell et al. ..... 313/643
2001/0003411 A1 * 6/2001 Honda et al. ..... 313/607
2002/0021093 A1 * 2/2002 Kakisaka et al. ..... 313/634
2002/0057058 A1 * 5/2002 Honda et al. ..... 313/578
2002/0070644 A1 * 6/2002 Dakin et al. ..... 313/25
2002/0101160 A1 * 8/2002 Kakisaka et al. ..... 313/623
2002/0145388 A1 * 10/2002 Kelly et al. ..... 313/623
2003/0076041 A1 * 4/2003 Honda et al. ..... 313/634

* cited by examiner

*Primary Examiner*—Vip Patel
*Assistant Examiner*—Glenn Zimmerman

(57) ABSTRACT

A metal vapor discharge lamp has an arc tube in which mercury, a rare gas, and at least one luminous metal are enclosed, and an outer tube in which a nitrogen gas is enclosed and which covers the arc tube. The metal members which are provided in the outer tube and which include wiring for supplying power to the arc tube will not react with one of nitrogen and a nitrogen compound in the nitrogen gas atmosphere in the outer tube when the temperature exceeds 350° C. in a steady-state illumination. The use of a metal member such as stainless steel will increase the life of the discharge lamp.

19 Claims, 4 Drawing Sheets

METAL VAPOR DISCHARGE LAMP

BACKGROUND OF THE INVENTION (1) Field of the Invention

The present invention relates to a metal vapor discharge lamp such as a metal halide lamp, and in particular, relates to a metal vapor discharge lamp having a nitrogen gas in its outer tube.

(2) Related Art

A general structure of a metal vapor discharge lamp is such that an arc tube having mercury, a rare gas, and a luminous metal, is placed in an outer tube already having a nitrogen gas therein, and that electrodes of the arc tube and a base of the outer tube are electrically connected by wiring members. A nitrogen gas is used as an inert filling gas, and also plays a role of maintaining the temperature of the arc tube to an adequate level during the lamp illumination. The wiring members are composed of a power supply line, a stem line, and the like, that are placed inside the outer tube. The wiring members are used to support the arc tube from inside the outer tube, and also used to hold a sleeve surrounding the arc tube, when necessary. Such wiring members are required to have a high-heat resistance property against the high temperature resulting during the lamp illumination. A conventional example of the wiring members is a metal member mainly composed of iron (e.g. iron, nickel-plated iron, and an iron-nickel alloy).

Meanwhile, the inventors of the present invention have observed that a conventional metal vapor discharge lamp has a problem in that a nitrogen gas pressure inside the outer tube will decrease as the lamp is used over a long period of time.

As a nitrogen gas pressure decreases as stated, a nitrogen gas ceases to work as a filling gas for the outer tube. Accordingly, the temperature in the arc tube will not be adjusted properly during the lamp illumination. As a result, it becomes very likely to cause a problem of changing the life property which is attributable to the increase in the vapor pressure of the arc tube. Furthermore, the internal pressure of the outer tube will decrease as the decrease in nitrogen gas. Accordingly, at such times as applying a high pressure pulse to the lamp, and non-illumination time attributable to leakage from the arc tube at the end of life of the lamp, it becomes possible that an arc discharge or a glow discharge is generated between the wires inside the outer tube (i.e. between opposite polarity electrodes), thereby causing an electrical breakdown.

This seriously damages the illuminating performance of lamps, and is considered a problem to be solved immediately.

SUMMARY OF THE INVENTION

The object of the present invention is to provide a metal vapor discharge lamp offering a favorable performance in that it can restrain any increase in metal vapor pressure inside the arc tube incident to the reduction in nitrogen gas in the outer tube, and so having smaller changes in life properties than conventionally, during the lamp illumination.

The inventors of the present invention devoted themselves to analyzing and studying, so as to solve the stated problem. As a result, they found that the main cause of reducing a nitrogen gas inside the outer tube, after the lamp is used over a long period of time, is as follows. That is, because the metal members provided inside the outer tube reacts chemically, being exposed to a high-temperature nitrogen gas atmosphere, thereby generating iron nitride, where the specific examples of the metal members are at least one of iron, nickel-plated iron, and an iron-nickel alloy. Specifically, this chemical reaction includes a process in which, under a condition in which the temperature of the nitrogen gas atmosphere within the outer tube exceeds 350° C. during the lamp illumination, a nitrogen component included in the outer tube reacts with a hydrogen component entered in the outer tube as an impurity to generate ammonia, and in turn this ammonia reacts with the metal members to generate iron nitride.

In view of this, a metal vapor discharge lamp of the present invention has a structure of including: an arc tube in which mercury, a rare gas, and at least one luminous metal are enclosed; an outer tube in which a nitrogen gas is enclosed and which covers the arc tube; and metal members which are provided in the outer tube and which include wiring for supplying power to the arc tube, where a metal material that reacts with one of nitrogen and a nitrogen compound is not adopted for any of the metal members that are exposed to a nitrogen gas atmosphere in the outer tube whose temperature exceeds 350° C. when the lamp is in a steady-state illumination.

In the conventional metal vapor discharge lamps, if the temperature of the nitrogen gas atmosphere exceeds 350° C. within the outer tube while the lamp is illuminated, a nitrogen component included in the outer tube reacts with a hydrogen component having entered in the outer tube as an impurity, to generate ammonia. And this ammonia, in turn, reacts with the metal members. However, according to the above-stated structure of the present invention, the metal members are not exposed to a nitrogen gas atmosphere which exceeds 350° C., in which ammonia is likely to be generated. Therefore, with the structure of the present invention, the occurrence of the mentioned reaction will be avoided, thereby restricting reduction of nitrogen gas. This means that, according to the present invention, even if after the lamp is used over a long period of time, the nitrogen gas pressure will be maintained, and so an arc discharge or a glow discharge will not happen between different polarity electrodes, and the electrical breakdown will not happen either. As a result, the lamp is able to keep offering a good life property for a long period of time.

Furthermore, a metal vapor discharge lamp of the present invention has a structure of including: an arc tube in which mercury, a rare gas, and at least one luminous metal are enclosed; an outer tube in which a nitrogen gas is enclosed and which covers the arc tube; and metal members which are provided in the outer tube and which include wiring for supplying power to the arc tube, where a metal material that reacts with nitrogen is not adopted for any of the metal members that are exposed to a nitrogen gas atmosphere in the outer tube whose temperature is of when the lamp is in a steady-state illumination.

According to this structure too, the metal members within the outer tube will be prevented from undergoing chemical reaction attributable to a nitrogen gas during the lamp illumination. Therefore, even if the lamp is used over a long period of time, the nitrogen gas pressure will be maintained, and so an arc discharge or a glow discharge will not happen between different polarity electrodes, and the electrical breakdown will not happen either. That is, the same effects will be obtained according to this structure as those achieved by the above-stated structure.

Furthermore, according to the present invention, it becomes possible to favorably maintain a nitrogen gas within the outer tube. Therefore, the temperature will be adjusted adequately, and so the arc tube will be prevented from being excessively heated. This means that the increase in vapor pressure inside the arc tube will be restrained during the lamp illumination, and so the property change attributable to this increase in vapor pressure will be prevented.

The present invention, as stated in the above, will be particularly effective if neither iron, nickel-plated iron, nor an iron-nickel alloy are adopted for any of the metal members that are exposed to the nitrogen gas atmosphere in the outer tube of when the lamp is in a steady-state illumination.

Furthermore, a metal vapor discharge lamp of the present invention may have a structure of including: an arc tube in which mercury, a rare gas, and at least one luminous metal are enclosed; an outer tube in which a nitrogen gas is enclosed and which covers the arc tube; and metal members which are provided in the outer tube and which include wiring for supplying power to the arc tube, where the metal members are chemically stable, at a temperature exceeding 350° C., in relation to one of nitrogen and a nitrogen compound. This structure will also yield the same effect as the above.

It should be noted here that the metal members may be structured by at least one selected from the group consisting of stainless, molybdenum, manganese, tantalum, tungsten, and titanium. Among them, molybdenum, manganese, tantalum, tungsten, and titanium are each chemically stable, and are stable if exposed to the high-temperature nitrogen gas. In addition, stainless, on surface of which a passive layer made of oxide tends to be formed, may be employed as a material chemically stable against the high-temperature nitrogen gas.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS (Embodiment 1)

1—1. Structure of Metal Vapor Discharge Lamp

Figure 1:
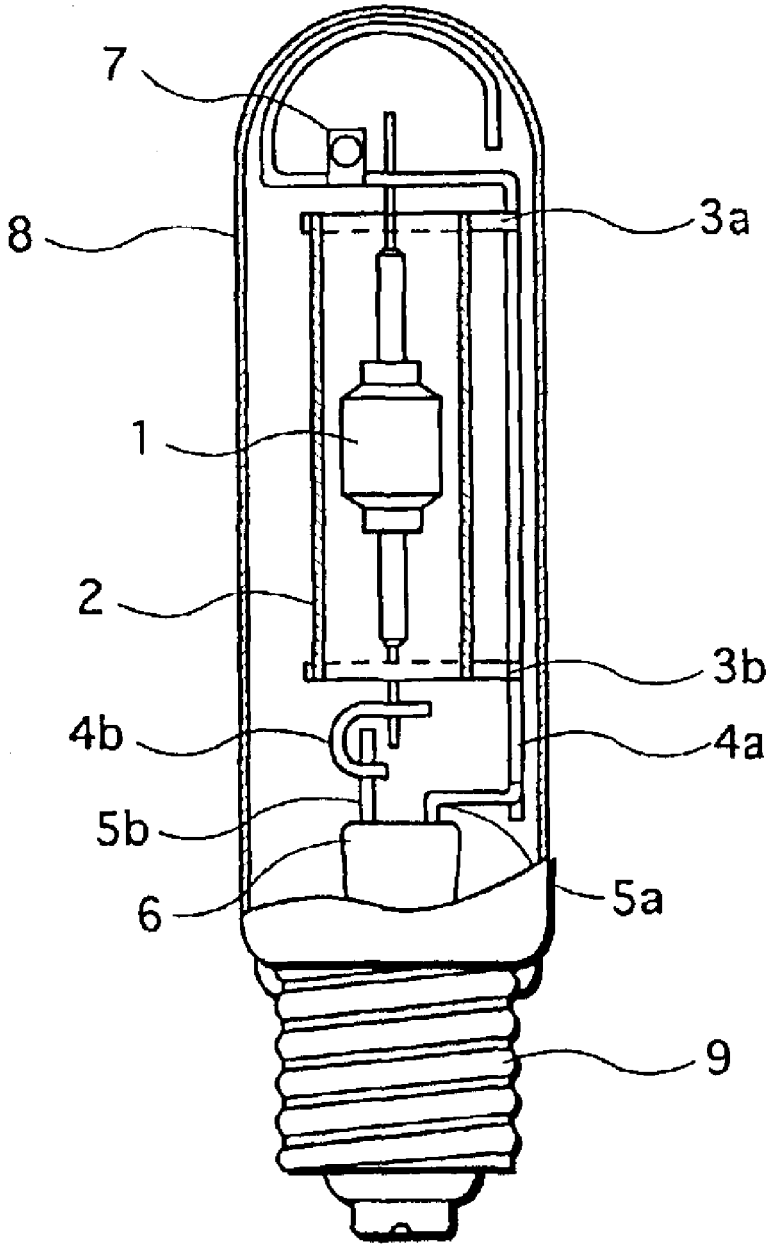
FIG. 1 shows a front sectional view showing a part of the metal vapor discharge lamp, in structure, which relates to the embodiment 1 of the present invention.

FIG. 1 is a front sectional view showing a part of the metal vapor discharge lamp, in structure, with an output of 250 W, which relates to the embodiment 1.

As shown in FIG. 1, the present metal vapor discharge lamp has a structure in which, inside a cylindrical outer tube 8 having a round bottom, a stem 6 made of heat-resistance glass is connected to an arc tube 1, via stem lines 5*a*, 5*b*, and the power supply lines 4*a*, 4*b*, that are wiring members, the arc tube 1 including therein a main tube 10, and thin tubes 11*a* and 11*b*, that are made of alumina ceramic. The sizes of the lamp are, for example, a length of 220 mm, and a diameter of 50 mm. Needless to say, however, the present invention is not limited to such sizes, or to the form of the outer tube.

In the outer tube 8, a nitrogen gas is enclosed at about 350 Torr. The opening of the outer tube 8 is sealed by a frit glass filled in a base 9 and between the base 9 and the outer tube 8. The power supply line 4*a* is equipped with a getter 7 made of zircon aluminum, which is used to mainly absorb an water impurity gas existing in the outer tube 8. Other materials may be used for this getter.

The arc tube 1, which is a light source of the metal vapor discharge lamp, is stored in a sleeve 2 made of silica glass in a cylindrical shape. This sleeve 2 prevents ultraviolet light from being released, and has an effect of thermally insulating the arc tube 1. The sleeve 2 maintains an adequate vapor pressure inside the arc tube 1 during the lamp illumination, and also works as a shock absorption that avoids leakage of the outer tube 8, in case of accidental breakage of the arc tube 1.

The stated sleeve 2 has two ends in a longitudinal direction, and these two ends are held by respective sleeve supporting plates 3*a* and 3*b* in doughnut-like shape, which are in turn fixed to the power supply line 4*a*.

Figure 2:
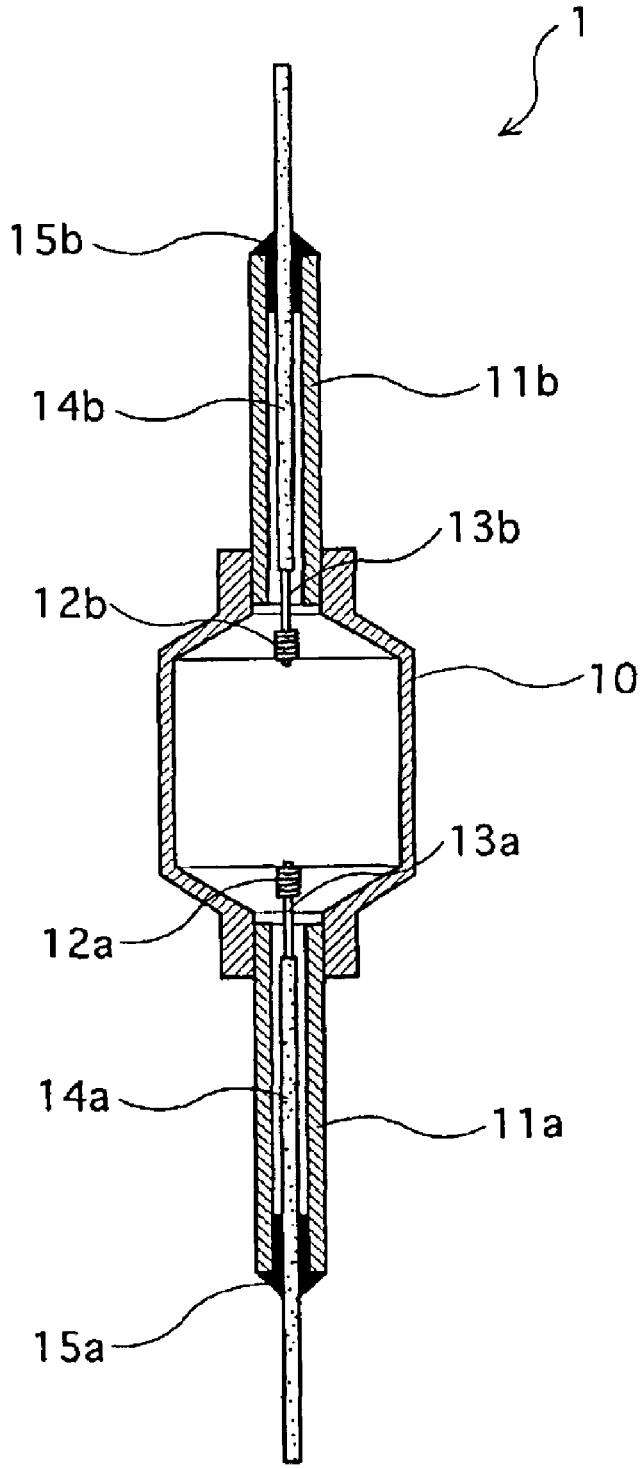
FIG. 2 shows a detailed structure of the arc tube.

FIG. 2 is a sectional diagram of the arc tube 1, showing its structure. The arc tube 1 shown in FIG. 2 has a structure of having, at both ends of a main tube 10, thin tubes 11*a* and 11*b* connected to the main tube 10, the main tube 10 having a discharge space therein. The sizes of the arc tube 1 are, for example, a length of 66 mm, and a total length of 88.0 mm when the feeding members 14*a* and 14*b* are included therein (to be more specific, the main tube having an outer diameter of 16.6 mm and a length of 29.4 mm, and the thin tubes having an inner diameter of 1.4 mm, an outer diameter of 4.4 mm, and a length of 18.3 mm).

In the discharge space formed inside the main tube 10, the following are enclosed: a rare gas such as argon used for starting up the lamp; mercury; and luminous substances including metal halides such as dysprosium iodide ($DyI_3$), thulium iodide ($TmI_3$), holmium iodide ($HoI_3$), thallous iodide (TlI), and sodium iodide (NaI).

In each of the thin tubes 11*a* and 11*b*, respective electrode coils 12*a*, 12*b*, electrode pins 13*a*, 13*b*, and conductive cermets 14*a*, 14*b* are inserted as feeding members, the conductive cermets working as an electrode supporting member. The electrode coils 12*a*, 12*b* are placed at the tip of the electrode pins 13*a*, 13*b* respectively, each electrode coil being placed to oppose the other inside the discharge space of the main tube 10. The electrode pins 13*a*, 13*b* are made of tungsten, and have the following sizes: an outer diameter of 0.71 mm, and a length of 5.2 mm. The conductive cermets 14*a*, 14*b* are connected to the respective electrode pins 13*a*, 13*b* to support these electrode pins, and have the following sizes: an outer diameter of 1.3 mm, and a length of 30 mm.

It should be noted that the conductive cermet referred to here is obtained, for example, by mixing alumina powder and heat-resistance metal powder such as molybdenum, and then firing them. The thermal expansion coefficient for this conductive cermet is substantially equal to that of alumina (i.e. $7.0\times10^{-6}$/K), which coincides with the thermal expansion coefficients for the main tube 10, and the thin tubes 11*a*, 11*b*.

In addition, in the thin tubes 11*a* and 11*b* in which the respective conductive cermets 14*a* and 14*b* have been inserted, glass frits 15*a*, 15*b* are each filled, thereby sealing the main tube 10. The glass frits 15*a*, 15*b* are filled throughout the thin tubes 11*a* and 11*b*, to an extent that there is some overflowed frits in the main tube 10, thereby enhancing hermeticity of the main tube 10.

Here, as a main characteristic of the metal vapor discharge lamp of the embodiment 1, the metal members such as the wiring members that are in contact with nitrogen gas filled in the outer tube 8 (i.e. the sleeve supporting plates 3*a*, 3*b*, the power supply lines 4*a*, 4*b*, the stem lines 5*a*, 5*b*, and the outer portion of the getter 7) are each made of a chemically stable material relative to the nitrogen gas atmosphere in the outer tube. Specifically, 18-8 stainless (SUS304) is used therefor as an example. This means that the embodiment 1 has a structure of not exposing a material that reacts with a nitrogen gas, to the nitrogen gas atmosphere within the outer tube which exceeds 350° C. in temperature during the lamp illumination.

In other words, the metal material for the wiring members that are in contact with the nitrogen gas filled in the outer tube 8 (i.e. the sleeve supporting plates 3*a*, 3*b*, the power supply lines 4*a*, 4*b*, the stem lines 5*a*, 5*b*, and the outer portion of the getter 7) are formed by a material which is chemically stable to the nitrogen gas atmosphere inside the outer tube. That is, in the embodiment 1, a material that reacts with a nitrogen gas (e.g. iron, nickel-plated iron, and an iron-nickel alloy) is not exposed to the nitrogen gas atmosphere in the outer tube.

The following details effects of the present invention having the stated structure.

1–2. Effect of the Present Embodiment

According to the metal vapor discharge lamp of the present embodiment 1 having the above structure, the metal members that are provided in the outer tube 8 (i.e. the sleeve supporting plates 3*a*, 3*b*, the power supply lines 4*a*, 4*b*, the stem lines 5*a*, 5*b*, and the outer portion of the getter 7) are chemically stable relative to the nitrogen gas atmosphere enclosed in the outer tube 8, inside of which the temperature reaches 350° C. or more during the lamp illumination. According to this structure, since the metal members will not react chemically with a nitrogen gas unlike conventionally, the arc tube 1 will be prevented from being excessively heated. More specifically, due to being exposed to the air for example, the stainless steel has the property of generating, on a surface thereof, a chemically stable corrosion-proof oxide coating (i.e. passive layer). This avoids chemical reaction occurring under high temperature, which is attributable to a nitrogen gas, thereby effectively preventing reduction of nitrogen gas and decrease in gas pressure within the outer tube 8.

Generally, the metal vapor discharge lamp has to have a part thereof which reaches several hundred degrees centigrade during illuminating the lamp, and to maintain a good conductivity even under such high temperature. Therefore, the lamp should have both of a high conductivity and a high heat resistance. From such reason, the conventional wiring material for the interior of the outer tube is a metal member mainly composed of iron, more specifically, a selected one from the group consisting of iron, nickel-plated iron, and an alloy made of iron and nickel. However, the inventors found that, when the lamp is illuminated, the iron component will chemically react attributable to the nitrogen gas of high temperature enclosed in the outer tube, thereby forming iron nitride. More specifically, a nitrogen gas, when exposed to a high temperature atmosphere, occasionally forms ammonia by being coupled to hydrogen usually included in silica glass included in such as a sleeve made of silica. Ammonia generated by this first reaction will then undergo the second reaction, in which ammonia reacts to iron by being heated in a high temperature atmosphere higher than 350° C., resulting finally in generation of iron nitride. Once iron nitride is generated, an internal pressure of the outer tube decreases, because a nitrogen gas in the outer tube has been indirectly consumed by the aforementioned chemical reactions. Originally, a nitrogen gas has a property of promoting heat dissipation of the lamp, and so plays a role of keeping the temperature adequate during illuminating the lamp. However, when the internal pressure of the outer tube decreases due to lack of nitrogen gas in the stated way, the arc tube will be under an excessively heated condition, thereby gradually elevating the vapor pressure of the luminous metal within the arc tube. This will adversely affect the life property of the lamp.

Such problem is just what the present invention intends to solve. In order to solve the problem, the present invention makes all of the sleeve supporting plates 3*a*, 3*b*, the power supply lines 4*a*, 4*b*, the stem lines 5*a*, 5*b*, and the outer portion of the getter 7, from 18-8 stainless (SUS304) that is chemically stable to the nitrogen gas atmosphere in the outer tube 8. This prevents unnecessary reaction with nitrogen gas and favorably restrains the elevation, of vapor pressure inside the arc tube 1 during the lamp illumination, thereby preventing a change in property incident to the elevation of the vapor pressure.

Furthermore, in the present invention, even when the high pressure pulse voltage is applied at the time of non-illumination due to a leakage from the arc tube 1 in the last stage of life, an electrical breakdown will be effectively prevented between opposite polarity electrodes. In a conventional example which uses metal members made of one of iron, nickel-plated iron, and an iron-nickel alloy, reaction attributable to a nitrogen gas occurs at around 350° C. Therefore, the present invention avoids occurrence of unnecessary chemical reaction, by using members made from 18-8 stainless (SUS304), which is stable relative to a nitrogen gas, and by not providing metal members made of iron, nickel-plated iron, and an iron-nickel alloy stated earlier in a place where it is exposed to a nitrogen gas atmosphere whose temperature in the outer tube exceeds 350° C., at the time of illuminating lamp.

Note here that in some cases for certain kinds of lamps, the inside of the outer tube 8 is subjected to hydrofluoric acid to provide a ground glass processing. In such a case, there is a possibility that remaining hydrofluoric acid will cause unnecessary chemical reaction, thereby corroding the metal members within the outer tube. Against such problem, too, the present invention is expected to yield a certain effect, because of the use of chemically stable metal members.

It should be noted here that materials for the metal member placed inside the outer tube 8, which are applicable to the present invention, include stainless steels of ferrite, martensite, austenite, and the like, that each include 10 wt % of chromium, and not limited to SUS304 stated earlier. This is because the passive layer will be formed if a material includes the stated amount of chromium, even if the base material is iron or steel, and this passive layer greatly improves a corrosion-proof property against a nitrogen gas.

2. Embodiment Examples and Quality Experiments

As an embodiment example, a metal vapor discharge lamp of the stated embodiment 1 was produced. At the same time, as a comparison example, a metal vapor discharge lamp was also produced whose metal members that were exposed to a nitrogen gas inside the outer tube 8 are all made of nickel-plated iron material (i.e. concretely, the metal members being the sleeve supporting plates 3*a*, 3*b*, the power supply lines 4*a*, 4*b*, the stem lines 5*a*, 5*b*, and an outer portion of the getter 7). In the outer tube of each lamp, a nitrogen gas of 350 Torr was enclosed when the temperature was cold (about 25° C.). Ten lamps were produced for each of the embodiment example and the comparison example, and life experiments were conducted to see chronological changes in properties.

Figure 3:
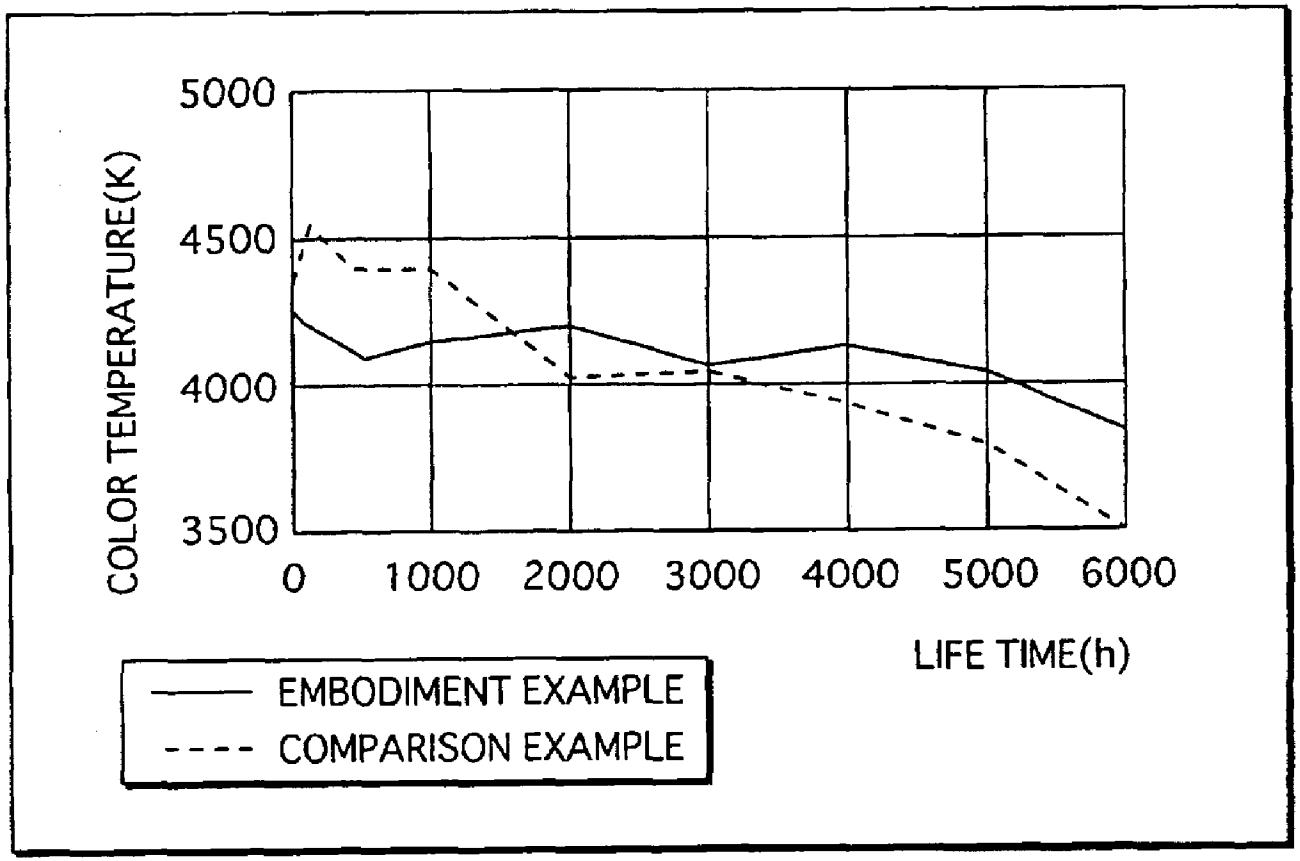
FIG. 3 shows changes in color temperature for both of a conventional example and the metal vapor discharge lamp of the embodiment 1 of the present invention, throughout their life.
Figure 4:
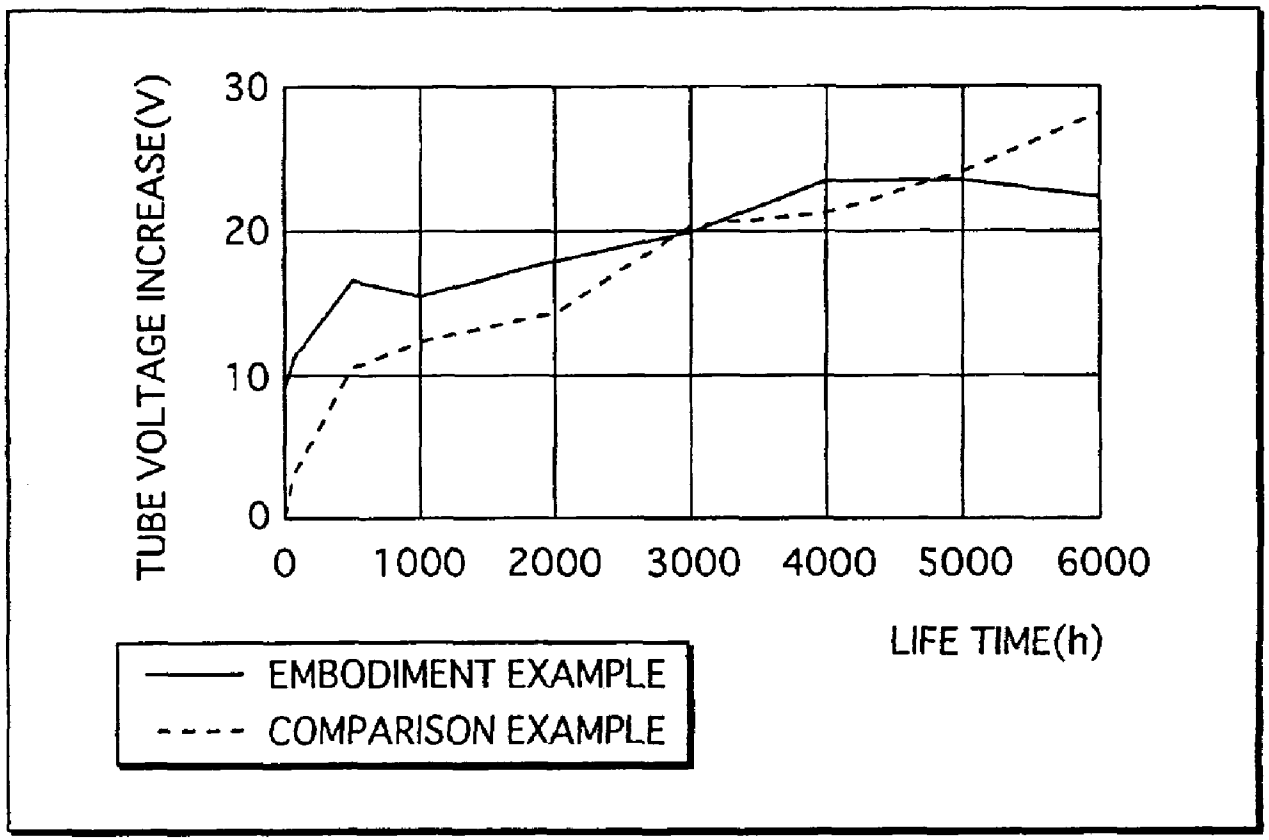
FIG. 4 shows increases in tube voltage for both of a conventional example and the metal vapor discharge lamp of the embodiment 1 of the present invention, throughout their life.

FIG. 3 and FIG. 4 are graphs summarizing the stated experiments.

Among the graphs, FIG. 3 is a graph showing changes in color temperature during the lives of the embodiment example and the comparison example, and FIG. 4 is a graph showing increases in tube voltage during the lives of the embodiment example and the comparison example. Please note that the tube voltage used here means a voltage actually applied to the lamp, and will increase in value due to, during the lamp life, such as a case where the vapor pressure becomes high because of the blackening inside the arc tube during its life, and a case where the distance between electrodes are elongated because the tips of the electrodes are deformed or flew. The large increase in value of the tube voltage will likely be a cause of early ending of the lamp's life.

In the graphs shown in FIG. 3 and FIG. 4, average values calculated for each of the ten embodiment examples and the ten comparison examples are plotted.

As shown in FIG. 3, it can be understood that the comparison example experiences comparatively large increase in color temperature during its life, whereas the embodiment example hardly experiences increase in color temperature. The change in color temperature represents a heating condition of the arc tube, and at the same time shows whether the evaporation of a variety of the luminous metals is properly pursued. Therefore, we can infer that since the embodiment example maintains enough nitrogen gas inside the outer tube, the embodiment example was able to perform excellently in terms of color temperature over a long period of time.

In addition, as shown in FIG. 4, the comparison example experiences large increase in tube voltage during its life, whereas the embodiment example has considerably restrained increase in tube voltage. The reason for this is understood that in the embodiment example, the temperature inside the arc tube will not become excessively high thanks to the heat dissipation action of nitrogen gas abundant in the outer tube over a long period of time. Therefore, the embodiment example has an effect of restraining the increase in vapor pressure inside the tube, and an effect of restraining reaction between the enclosed luminous metal and the feeding member, or between the luminous metal and the arc tube wall, resulting in restrained increase in tube voltage.

Here, all the lamps of the embodiment example and the comparison example were lit for 6000 hours to lead their arc tubes to compulsory leakage, then a pulse voltage having its peak voltage of 5 kV was applied thereto. The result shows that all the ten lamps of the comparison example generated glow discharge between different polarity electrodes, whereas none of the embodiment example generated any discharge between different polarity electrodes.

Furthermore, the lamps of the embodiment example and the comparison example had been lit over 6000 hours, and five lamps out of each example were compared at a time, for examining the nitrogen gas pressure in the outer tube at a cool temperature. The result shows that the comparison example shows a reduced pressure in a range of 280±20 Torr, whereas the embodiment example has the pressure of in a range of 350±20 Torr, which is about the same nitrogen gas pressure before the lamp started operating.

Taking the above into consideration, it can be understood that the reason why the comparison example yielded large change in color temperature and large increase in tube voltage during its life is that the wiring members made of metal chemically react attributable to the nitrogen gas in the outer tube. More specifically, what has happened to the comparison example is inferred as follows: due to this chemical reaction, the amount of nitrogen gas is reduced in the arc tube, thereby inhibiting heat dissipation from the arc tube that would have been pursued by the nitrogen gas. This led to increase in temperature in the arc tube, and further to increase in vapor pressure in the arc tube. Since usually, when the nitrogen gas in the outer tube decreases, and the internal pressure becomes low, discharge between opposite polarity electrodes will likely occur. Therefore, because of the above, the glow discharge is considered to have occurred in many of the comparison examples.

3. Other Things to Remember

In the embodiment 1, an example is shown which uses alumina ceramic as a material of the arc tube. However, the present invention is not limited to such, and other materials such as silica may be used for the arc tube.

In addition, the structure of the lamp is not limited to a stem-included structure or a single base type that are shown by the embodiment 1, and can be applied to lamps of other forms (such as double base type and a short arc type).

Furthermore, a material for members used in the outer tube 8 is stainless SUS 304 in the present invention. However, the material is not limited to such, and may also be a variety of stainless, molybdenum (Mo), manganese (Mn), tantalum (Ta), tungsten (W), and titanium (Ti), that have a property of being hard to react to a nitrogen gas at a high temperature no smaller than 350° C. A single use of the above materials is possible, whereas the combined use of some of the above materials is also possible.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A metal vapor discharge lamp comprising:

an arc tube in which mercury, a rare gas, and at least one luminous metal are enclosed;

an outer tube in which a nitrogen gas is enclosed and which covers the arc tube; and metal members which are provided in the outer tube and which include 1) stem lines extending from a stem provided at one end of the outer tube, 2) external lead lines extending from the arc tube, and 3) power supply lines through which the stem lines are connected to the external lead lines, wherein a metal material that reacts with one of nitrogen and a nitrogen compound is not adopted for any of the metal members that are exposed to a nitrogen gas atmosphere in the outer tube whose temperature exceeds 350° C. when the lamp is in a steady-state illumination.

2. The metal vapor discharge lamp of claim 1, wherein neither iron, nickel-plated iron, nor an iron-nickel alloy are adopted for any of the metal members that are exposed to the nitrogen gas atmosphere in the outer tube whose temperature exceeds 350° C. when the lamp is in a steady-state illumination.

3. The metal vapor discharge lamp of claim 1, wherein the arc tube is covered with a sleeve made of silica glass and is provided in a nitrogen gas atmosphere in the outer tube.

4. The metal vapor discharge lamp of claim 1, wherein the arc tube has a thin-tube part which is connected to a member external to the arc tube, a conductive cermet is inserted into the thin-tube part as a feeding member, and a glass frit containing a silica component is filled in an area formed between the conductive cermet and the thin-tube part so as to seal the arc tube.

5. A metal vapor discharge lamp, comprising:

an arc tube in which mercury, a rare gas, and at least one luminous metal are enclosed;

an outer tube in which a nitrogen gas is enclosed and which covers the arc tube; and metal members which are provided in the outer tube and which include 1) stem lines extending from a stem provided at one end of the outer tube, 2) external lead lines extending from the arc tube, and 3) power supply lines through which the stem lines are connected to the external lead lines, wherein the metal members are chemically stable, at a temperature exceeding 350° C., in relation to one of nitrogen and a nitrogen compound.

6. The metal vapor discharge lamp of claim 5 wherein the metal members are, selected from the group consisting of stainless steel, molybdenum, manganese, tantalum, tungsten, and titanium.

7. The metal vapor discharge lamp of claim 5, wherein the arc tube is covered with a sleeve made of silica glass and is provided in a nitrogen gas atmosphere in the outer tube.

8. The metal vapor discharge lamp of claim 5, wherein the arc tube has a thin-tube part which is connected to a member external to the arc tube, a conductive cermet is inserted into the thin-tube part as a feeding member, and a glass frit containing a silica component is filled in an area formed between the conductive cermet and the thin-tube part so as to seal the arc tube.

9. A metal vapor discharge lamp comprising:

an arc tube in which mercury, a rare gas, and at least one luminous metal are enclosed;

an outer tube in which a nitrogen gas is enclosed and which covers the arc tube; and metal members which are provided in the outer tube and which include 1) stem lines extending from a stem provided at one end of the outer tube, 2) external lead lines extending from the arc tube, and 3) power supply lines through which the stem lines are connected to the external lead lines, wherein a metal material that reacts with nitrogen is not adopted for any of the metal members that are exposed to a nitrogen gas atmosphere in the outer tube when the lamp is in a steady-state illumination.

10. The metal vapor discharge lamp of claim 9, wherein neither iron, nickel-plated iron, nor an iron-nickel alloy are adopted for any of the metal members that are exposed to the nitrogen gas atmosphere in the outer tube of when the lamp is in a steady-state illumination.

11. The metal vapor discharge lamp of claim 9, wherein the arc tube is covered with a sleeve made of silica glass and is provided in a nitrogen gas atmosphere in the outer tube.

12. The metal vapor discharge lamp of claim 9, wherein the arc tube has a thin-tube part which is connected to a member external to the arc tube, a conductive cermet is inserted into the thin-tube part as a feeding member, and a glass frit containing a silica component is filled in an area formed between the conductive cermet and the thin-tube part so as to seal the arc tube.

13. A metal vapor discharge lamp comprising:

an arc tube in which mercury, a rare gas, and at least one luminous metal are enclosed;

an outer tube in which a nitrogen gas is enclosed and which covers the arc tube; and metal members which are provided in the outer tube and which include 1) stem lines extending from a stem provided at one end of the outer tube, 2) external lead lines extending from the arc tube, and 3) power supply lines through which the stem lines are connected to the external lead lines, wherein the metal members are chemically stable in relation to the nitrogen gas in the outer tube.

14. The metal vapor discharge lamp of claim 13 wherein the metal members are selected from the group consisting of stainless steel, molybdenum, manganese, tantalum, tungsten, and titanium.

15. The metal vapor discharge lamp of claim 13 wherein the arc tube is covered with a sleeve made of silica glass and is provided in a nitrogen gas atmosphere in the outer tube.

16. The metal vapor discharge lamp of claim 14, wherein the arc tube has a thin-tube part which is connected to a member external to the arc tube, a conductive cermet is inserted into the thin-tube part as a feeding member, and a glass frit containing a silica component is filled in an area formed between the conductive cermet and the thin-tube part so as to seal the arc tube.

17. The metal vapor discharge lamp of claim 1 wherein stainless steel constitutes the metal members within the outer tube and exposed to nitrogen gas.

18. A metal vapor discharge lamp comprising:

an arc tube in which mercury, a rare gas, and at least one luminous metal are enclosed, wherein the arc tube has a thin-tube part which is connected to a member external to the arc tube, a conductive cermet is inserted into the thin-tube part as a feeding member, and a glass frit containing a silica component is filled in an area formed between the conductive cermet and the thin-tube part so as to seal the arc tube;

an outer tube in which a nitrogen gas is sealingly enclosed and which covers the arc tube;

a getter member, inert to nitrogen gas, for removing water is operatively mounted within the outer tube;

a sleeve member open at each end is provided in the outer tube to surround the arc tube; and metal members selected from the group consisting of stainless steel, molybdenum, manganese, tantalum, tungsten, and titanium are provided and exposed in the outer tube and include wiring for supplying power to the arc tube, wherein the metal members are chemically stable in relation to the nitrogen gas in the outer tube.

19. The metal vapor discharge lamp of claim 18 wherein the arc tube is covered with a sleeve made of silica glass and is provided in a nitrogen gas atmosphere in the outer tube.

* * * * *